US005088296A

United States Patent [19]

Hamaoka

[11] Patent Number: 5,088,296

[45] Date of Patent: Feb. 18, 1992

[54] AIR CONDITIONER SYSTEM WITH REFRIGERANT CONDITION DETECTION FOR REFRIGERANT RECOVERING OPERATION

[75] Inventor: Makoto Hamaoka, Fujinomiya, Japan

[73] Assignee: Kabushiki Kaisha Toshiba, Kawasaki, Japan

[21] Appl. No.: 442,199

[22] Filed: Nov. 28, 1989

[30] Foreign Application Priority Data

Nov. 30, 1988 [JP] Japan ..... 63-300912

[51] Int. Cl.[5] ..... F25B 29/00; F25B 41/00; F24F 5/00

[52] U.S. Cl. ..... 62/174; 62/324.4; 62/115; 62/238.6; 62/238.7; 237/2 B; 165/29

[58] Field of Search ..... 165/29; 62/238.6, 238.7, 62/115, 324.4, 174; 237/2 B

[56] References Cited

U.S. PATENT DOCUMENTS 4,441,331 4/1984 Yuyama ..... 165/29
4,482,008 11/1984 Nomaguchi ..... 62/238.6
4,484,452 11/1984 Houser, Jr. ..... 62/174
4,506,521 3/1985 Asano et al. ..... 62/324.1
4,516,408 5/1985 Chiba ..... 62/238.7
4,802,529 2/1989 Sumitani et al. ..... 62/238.6
4,905,894 3/1990 Noguchi ..... 237/2 B

FOREIGN PATENT DOCUMENTS 63-83556 4/1988 Japan .

*Primary Examiner*—John K. Ford
*Attorney, Agent, or Firm*—Cushman, Darby & Cushman

[57] ABSTRACT

A heat pump refrigeration system has a refrigerant condition detector for detecting the mass of refrigerant in the system and initializing a refrigerant mass recovery operation. The heat pump system comprises three flow paths. When a cooling operation is performed, refrigerant flows in a first flow path through a compressor, outdoor heat exchanger, indoor heat exchanger, and the compressor, respectively. During a heating operation, refrigerant flows in a second flow path through the compressor, indoor heat exchanger, a refrigerant heater and the compressor, respectively. The system has a third flow path used during the refrigerant mass recovery operation. A controller causes the heating operation to continue in response to an appropriate signal from the condition detector. When the condition detector indicates an inappropriate refrigerant condition, the controller causes fluid to flow through the third flow path for a predetermined time period.

7 Claims, 2 Drawing Sheets

AIR CONDITIONER SYSTEM WITH REFRIGERANT CONDITION DETECTION FOR REFRIGERANT RECOVERING OPERATION

BACKGROUND OF THE INVENTION

1. Field of the Invention

The present invention generally relates to an air conditioner system and, more particularly, to an air conditioner which can also be used for heating by employing a refrigerant heater as a heat source.

2. Description of the Related Art

A heat pump refrigeration cycle system air conditioner, for performing a heating operation by employing a refrigerant heater as a heat source, has been conventionally known.

In such an air conditioner, a heating operation is normally preced by a refrigerant mass recovery operation, performed during a predetermined time period before the start of the heating operation.

This is because, during a refrigeration cycle of an air conditioner of this type, a finite quantity of refrigerant remains stored in an outdoor heat exchanger having a lowest ambient temperature. This refrigerant must be withdrawn from the outdoor heat exchanger and added to the remainder of the system prior to a heating operation.

If a heating operation is started without first performing a refrigerant mass recovery operation, the mass flow of refrigerant which circulates in the refrigeration cycle may be insufficient. If the flow through the refrigerant heater is too low, the refrigerant may become overheated, and a stable heating operation cannot be achieved.

When the refrigerant mass recovery operation is performed, a smooth shift to a stable heating operation can be achieved. However, the start of the heating operation will be delayed by the time period required to preform the refrigerant mass recovery operation. This delay is inconvenient for a user.

Moreover because the refrigerant mass recovery operation in the conventional air conditioner is performed at the start of the heating operation regardless of the refrigerant's pressure or temperature, the user may incur further undue delay.

In other words, when the outside ambient temperature is low, or when a heating operation is started after the air conditioner has not been used for a long period of time, the refrigerant mass recovery operation must be executed. However, these two conditions necessitating the need for performing the refrigerant mass recovery operation are not always present.

SUMMARY OF THE INVENTION

It is, therefore, an object of the present invention to provide a new and improved air conditioner with a refrigerant condition detection for a refrigerant mass recovery operation which can reasonably achieve the earlier start of a heating operation, and which can provide a more stable system operation with a sufficient quantity of refrigerant.

It is another object of the present invention to provide a method of controlling an air conditioner which can reasonably achieve the earlier start of a heating operation, and which can provide a more stable system operation with a sufficient quantity of refrigerant.

According to one aspect of the present invention, there is provided an air conditioner comprising:

refrigeration cycle means, serving as a heat pump type refrigeration cycle, for causing (1) a refrigerant filled in the refrigeration cycle to circulate through a first path of a compressor, an outdoor heat exchanger, an indoor heat exchanger, and the compressor, in that order, during a cooling operation; the refrigerant to circulate through a second path of the compressor, the indoor heat exchanger, a refrigerant heater, and the compressor, in that order, during a heating operation; and (3) the formation of a third path which allows the refrigerant stored in at least the outdoor heat exchanger to be withdrawn from the outdoor heat exchanger and supplied to the compressor during a refrigerant mass recovery operation associated with the heating operation;

refrigerant condition detecting means, for detecting a condition of the refrigerant which circulates through the second path during the heating operation and for supplying an output thereof; and control means, for controlling the refrigeration cycle means in accordance with the an output detected by the refrigerant condition detecting means, for continuing the heating operation when the detection output represents an appropriate condition of the refrigerant, for closing the second path during a predetermined time period and recovering the refrigerant through the third path in order to temporarily stop the heating operation, and for performing the refrigerant recovering operation when the detection output represents an inappropriate condition of the refrigerant.

According to another aspect of the present invention, there is provided a method of controlling an air conditioner including a refrigeration cycle constituted by sequentially causing a compressor, a four-way valve, an outdoor heat exchanger, a check valve, a decompressor, and an indoor heat exchanger to communicate with each other, and by sequentially causing an opening/closing valve and a refrigerant heater to communicate with each other from a communication section between the check valve and the decompressor to the compressor, comprising the steps of:

executing a heating operation by operating the compressor, switching the four-way valve, and opening the opening/closing valve;

sensing a temperature of the refrigerant discharged from the refrigerant heater;

counting the number of times when the sensed temperature of the refrigerant exceeds a preset value during the heating operation; and executing a refrigerant mass recovery operation by closing the opening/closing valve only when the counted number of times reaches the preset value during the heating operation.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings illustrate presently preferred embodiments of the invention and, together with the general description given above and the detailed description of the preferred embodiments given below, serve to explain the principles of the invention, in which.

DETAILED DESCRIPTION OF THE PREFERRED EMBODIMENT

Figure 1:
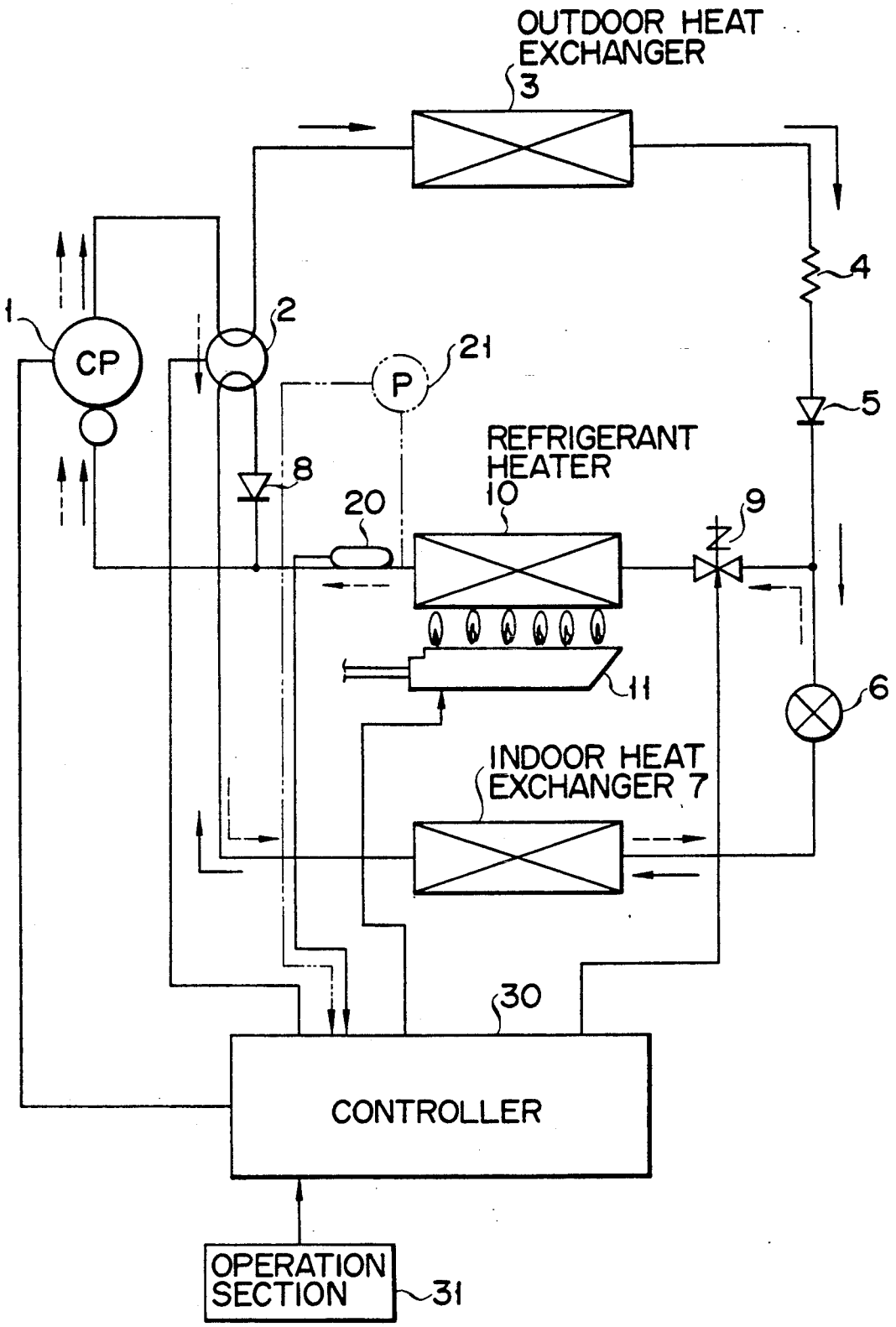
FIG. 1 is a block diagram showing an air conditioner according to an embodiment of the present invention.

Referring to FIG. 1, reference numeral 1 denotes a compressor. A four-way valve 2, an outdoor heat exchanger 3, a capillary tube 4, a check valve 5, an expansion valve 6, an indoor heat exchanger 7, and a check valve 8 sequentially communicate with the compressor 1 to constitute a heat pump refrigeration cycle.

An opening/closing solenoid valve 9 and a refrigerant heater 10 sequentially communicate with each other from a communication section between the check valve 5 and the expansion valve 6 to a refrigerant inlet-side pipe of the compressor 1.

A gas burner 11 is arranged near the refrigerant heater 10. This gas burner 11 burns a gas supplied from a fuel source (not shown) to heat the refrigerant heater 10.

During a cooling operation, the compressor 1 is started and the opening/closing valve 9 is closed. A refrigerant flows in a direction indicated by the solid arrows in FIG. 1 to form a cooling cycle, and the outdoor and indoor heat exchangers 3 and 7 serve as a condenser and an evaporator, respectively.

During a heating operation, the compressor 1 is started and the four-way valve 2 is switched and operated. In addition, the opening/closing valve 9 is opened, and the refrigerant flows in a direction indicated by the broken arrows in FIG. 1 to form a heating cycle. The indoor heat exchanger 7 and the refrigerant heater 10 serve as a condenser and an evaporator, respectively.

As shown in FIG. 1, a temperature sensor (temperature evaporator output sensor: TEO sensor) 20 is arranged at a refrigerant outlet-side pipe of the refrigerant heater 10. In addition, a controller 30 is arranged.

The controller 30 controls overall operations of the air conditioner, and includes a microcomputer and its peripheral circuits.

The controller 30 is connected to the compressor 1, the four-way valve 2, the opening/closing valve 9, the gas burner 11, the temperature sensor 20, and an operation section 31.

The controller 30 includes (1) a function means for operating the compressor 1, switching the four-way valve 2, and opening the opening/closing valve 9 to execute a heating operation; (2) a function means for counting the number of times N when the temperature Teo sensed by the temperature sensor 20 exceeds a preset value Ts during the heating operation; and (3) a function means for closing the opening/closing valve 9 when N reaches a preset value Ns to begin execution of a refrigerant mass recovery operation during the heating operation; and (4) a function means for normally controlling a cooling operation.

With the above arrangement, the heating operation will be described below with reference to FIG. 2.

The operation section 31 sets a heating operation mode, and performs a starting start operation.

Then, the controller 30 starts the compressor 1, switches and operates the four-way valve 2, opens the opening/closing valve 9, and ignites the gas burner 11.

Thereafter, refrigerant is discharged from the compressor 1, and the discharged refrigerant is supplied to the indoor heat exchanger 7 through the four-way valve 2. The refrigerant is cooled by indoor air, and is condensed and liquefied.

The liquid refrigerant is decompressed by the expansion valve 6, and flows into the refrigerant heater 10 through the opening/closing valve 9. Heat is received by the refrigerant from the gas heater, and the refrigerant vaporizes. The vaporized refrigerant returns to the compressor 1 thus completing the heating cycle.

During this heating operation, if a quantity of the refrigerant is stored in the outdoor heat exchanger 3, the mass flow of refrigerant supplied to the refrigerant heater 10 is insufficient, thereby increasing a resulting in an increase of the temperature of the refrigerant discharged from the refrigerant heater 10.

The controller 30 causes the temperature sensor 20 to sense the temperature of the refrigerant discharged from the refrigerant heater 10 (step S2). If the temperature Teo sensed by the temperature sensor 20 exceeds the preset value Ts (e.g. 70° C.), the operation of the compressor 1 is temporarily stopped.

When this occurs, the compressor 1 is restarted after a while (e.g., a few seconds later). However, since the mass flow of refrigerant is still insufficient, the sensed temperature Teo quickly exceeds the preset value Ts again, and the operation of the compressor 1 is stopped by the controller (steps S3, S4, and S5).

The controller 30 counts the number of times N when the sensed temperature Teo exceeds the preset value Ts. If N reaches the preset value Ns (e.g., three times), a refrigerant mass recovery operation is executed (step S6).

Note that this mass recovery operation is performed in order to prevent that a transient change in refrigerant is detected as a refrigerant shortage condition, and a shift to a refrigerant mass recovery operation mode, which is not essentially required, may be performed.

More specifically, while the compressor 1 is started and the four-way valve 2 is switched and operated, the opening/closing valve 9 is closed.

When the opening/closing valve 9 is closed, the mass of refrigerant stored in the outdoor heat exchanger 3 is drawn into the compressor 1 through the four-way valve 2 and the check valve 8.

After this refrigerant recovering operation is executed during a predetermined period of time (e.g., one minute), the controller 30 opens the opening/closing valve 9, resets the counted value, and returns to the heating operation (step S7).

Thus, if the refrigerant mass recovery operation is not executed at the start of the heating operation, a heating operation can be started much sooner than if the heating were needlessly delayed by the mass recovery operation. Thus, the time period required for warm wind to be blown from the indoor heat exchanger side can be reduced.

In addition, when the quantity of refrigerant in the system is insufficient, this condition is reliably detected and the refrigerant recovering operation is executed. Therefore, a stable operation can always be achieved.

Furthermore, the temperature sensor 20 is arranged to control the operation of gas burner 11. Since the sensor 20 can be used to sense both the combustion amount and the temperature of the refrigerant, additional parts are not required, thus preventing an increase in cost.

Note that although the temperature of the refrigerant is directly sensed by the temperature sensor 20 in the above embodiment, the temperature can be indirectly sensed by the controller using, a pressure sensor 21, represented by the dashed line in FIG. 1.

In addition, the refrigerant's condition at the outlet of heater 10 can be detected in accordance with outputs from both the temperature sensor 20 and the pressure sensor 21.

This invention is not limited to the above embodiment, and various changes and modifications may be made without departing from the spirit and scope of the invention.

Figure 2:
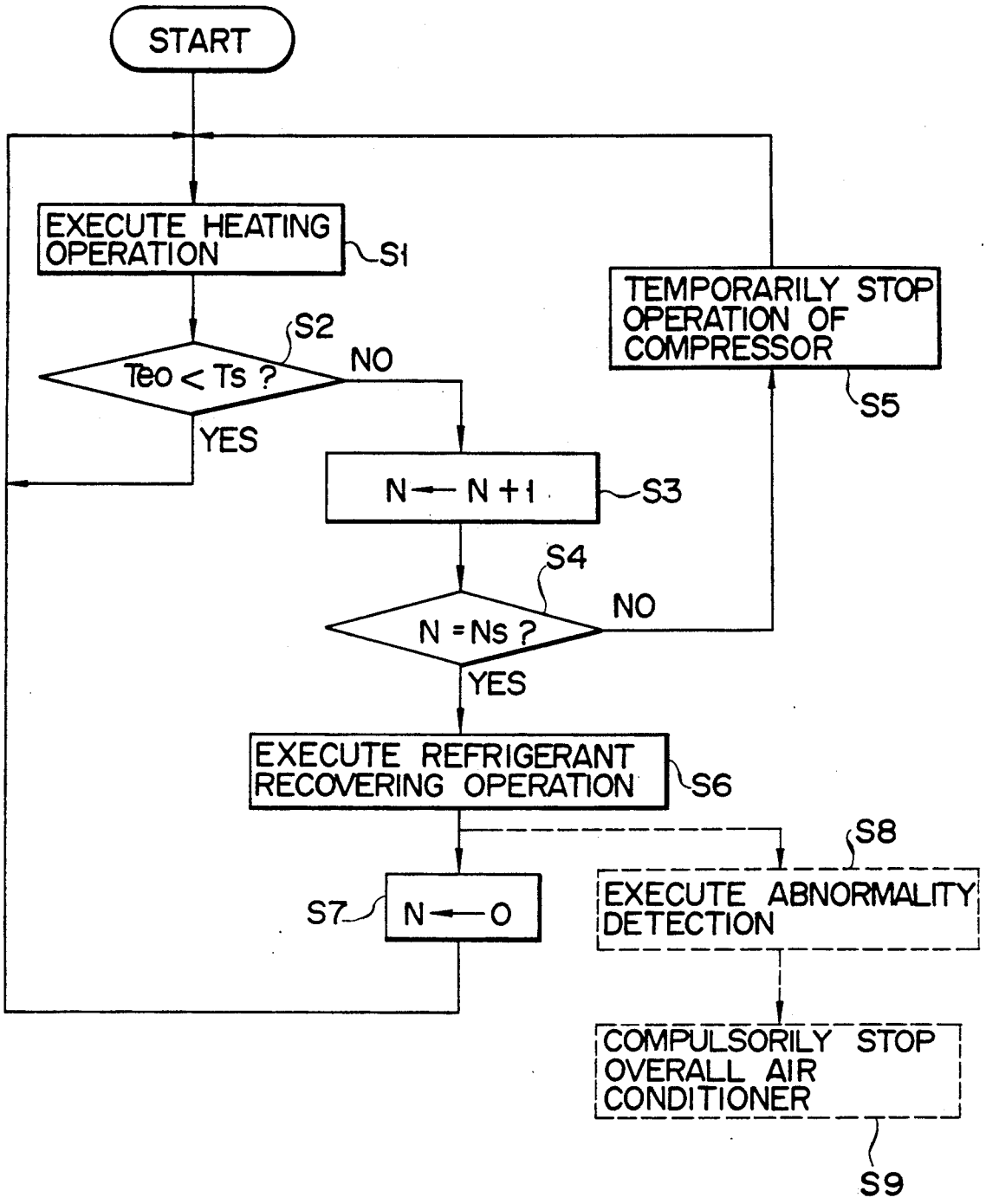
FIG. 2 is a flow chart for explaining an operation of the air conditioner shown in FIG. 1.

For example, an operation represented by the broken line in FIG. 2 can be performed. That is, the controller 30 counts the number of refrigerant mass recovery operations. If the count exceeds the preset number (e.g., three times), an abnormality detection operation may be executed in order to stop the overall operation of the air conditioner (steps S8 and S9). More specifically, if refrigerant mass recovery operations must be frequently performed during a heating operation, this indicates that some abnormality exists in the system. Therefore, in this case, the overall operation of the air conditioner is stopped, and a cause of the failure is checked, thus taking the necessary countermeasure as described above.

As described above, according to the present invention, the air conditioner includes a refrigeration cycle constituted by sequentially causing, the compressor, the four-way valve, the outdoor heat exchanger, the check valve, the decompressor, and the indoor heat exchanger to communicate with each other, and sequentially causing the opening/closing valve and the refrigerant heater to communicate with each other, a means for operating the compressor, switching the four-way valve, and opening the opening/closing valve to execute a heating operation, a temperature sensor for sensing a temperature of the refrigerant discharged from the refrigerant heater, a means for counting the number of times when the temperature sensed by the temperature sensor exceeds a preset value during a heating operation, and a means for closing the opening/closing valve when the counted number of times reaches the preset value during the heating operation to execute the refrigerant mass recovery operation. Therefore, there is provided an air conditioner which can start a heating operation earlier, and can achieve a more stable operation with a sufficient quantity of refrigerant.

What is claimed is:

1. An air conditioner, comprising:

a compressor;

an outdoor heat exchanger;

an expansion valve;

an indoor heat exchanger;

a refrigerant heater;

means for causing refrigerant to circulate through a first flow path during a cooling operation, the first flow path sequentially including the compressor, outdoor heat exchanger, expansion valve, indoor heat exchanger, and compressor;

means for causing refrigerant to circulate through a second flow path during a heating operation, the second flow path sequentially including the compressor, indoor heat exchanger, expansion valve, refrigerant heater, and compressor;

means for causing refrigerant to circulate through a third flow path during a refrigerant mass recovery operation associated with the heating operation, whereby refrigerant stored in the outdoor heat exchanger is withdrawn therefrom and is drawn into the compressor;

refrigerant condition detecting means, for detecting a condition of the refrigerant in the second flow path and for providing a first output signal indicative thereof, the detecting means including means for directly sensing a temperature of the refrigerant; and control means, for controlling the air conditioner in response to the first output signal by continuing the heating operation when the first output signal indicates an appropriate condition of the refrigerant, and by initiating the mass recovery operation when a predetermined number of determinations of an inappropriate condition of the refrigerant is reached, the control means including:

means for comparing the first output signal to a reference value during a predetermined short period, to determine the condition of the refrigerant, means for temporarily stopping the operation of the compressor when the inappropriate condition has been determined, means for counting the number of determinations of the inappropriate condition and generating a second output signal indicative thereof, and means for executing the refrigerant mass recovery operation when the second output signal reaches the predetermined value.

2. An air conditioner according to claim 1, wherein the refrigerant condition detecting means includes a temperature sensor for sensing a temperature of the refrigerant on an outlet side of the refrigerant heater.

3. An air conditioner according to claim 1, wherein the second path includes an opening/closing solenoid valve set in an open state during the heating operation.

4. An air conditioner according to claim 3, wherein the control means includes means for switching the opening/closing solenoid valve to a closed state when the refrigerant mass recovery operation is executed.

5. An air conditioner according to claim 1, wherein the control means includes means for detecting an abnormality in accordance with a number of refrigerant mass recovery operations performed, and for generating a third output signal indicative thereof.

6. An air conditioner according to claim 5, wherein the control means includes means for stopping the overall operation of the air conditioner in response to the third output signal.

7. An air conditioner according to claim 2, wherein the temperature sensor is also used to control the amount of heat supplied by the refrigerant heater.

* * * * *